US010800053B1

(12) United States Patent
Liu

(10) Patent No.: US 10,800,053 B1
(45) Date of Patent: Oct. 13, 2020

(54) TRIGGER KNIFE

(71) Applicant: Tsang Wing Wong, Kowloon (HK)

(72) Inventor: Jiajie Liu, Kowloon (HK)

( * ) Notice: Subject to any disclaimer, the term of this patent is extended or adjusted under 35 U.S.C. 154(b) by 0 days.

(21) Appl. No.: 16/536,329

(22) Filed: Aug. 9, 2019

(51) Int. Cl.
*B26B 1/08* (2006.01)
*B26B 5/00* (2006.01)

(52) U.S. Cl.
CPC ..... *B26B 5/003* (2013.01)

(58) Field of Classification Search
CPC ..... B26B 1/08; B26B 5/003; B26B 5/001; B26B 9/00; B26B 1/046; B26B 11/00; B26B 5/042; B26B 1/02
USPC .... 30/162, 164, 346.61, 337, 335, 163, 336, 30/334, 151, 158, 159.16, 161
See application file for complete search history.

(56) References Cited

U.S. PATENT DOCUMENTS 5,207,696 A * 5/1993 Matwijcow ..... A61B 17/3211 30/151
6,623,499 B1 * 9/2003 Andreini ..... A61B 17/3211 30/329
2010/0223793 A1 * 9/2010 Hansen ..... B26B 9/00 30/162
2016/0167239 A1 * 6/2016 Gallegos ..... B26B 5/003 30/162

* cited by examiner

*Primary Examiner* — Ghassem Alie

(57) ABSTRACT

A trigger knife, having a knife body, a knife rack, a blade, a resilient piece, a trigger, a transmission mechanism and a blocking piece; the resilient piece provides resilient force to retract the blade; the trigger is partially exposed from the knife body; the transmission mechanism has first and second gear racks, and first and second gears; the first gear and the second gear are connected to the knife body; the first gear rack is provided on the trigger and engages with the first gear; the second gear rack is provided on the knife rack and engages with the second gear; the knife rack is provided with a groove; the groove extends in the same direction along which the knife rack extends; when the blade is extended to a desired position, the blocking piece abuts against a wall surface of the groove.

10 Claims, 8 Drawing Sheets

TRIGGER KNIFE

BACKGROUND OF THE INVENTION

The present invention relates to the technical field of hand-held safety knife, and more particularly relates to a trigger knife.

Trigger knife is a kind of hand-held safety knife, wherein a blade of the trigger knife can be retracted into a knife body, and extends out of the knife body only during use upon pressing of the trigger by the user, thereby enhancing the safeness of the trigger knife.

CN101885183A discloses a safety cutting knife, specifically comprising a shell, a dismountable blade protection sleeve provided at an end of the shell, and a blade fixedly connected to a rotary knife rack; two ends of a first tensional spring disposed inside a cavity of the shell are connected to the shell and a slidable buckle respectively; two ends of a second tensional spring are connected to the shell and a slidable knife rack respectively; one end of a trigger is connected to the shell via pivot point E, another end of the trigger can move up and down by movement about the pivot point E; one end of a second linkage rod is connected to the slidable buckle, and another end of the second linkage rod is connected to one end of a first linkage rod via an aperture provided at an upper portion of the trigger; another end of the first linkage rod is connected with the shell; the slidable knife rack can slide laterally inside the cavity of the shell; the slidable knife rack is fitted to a cylindrical projection F of the rotary knife rack, and can rotate by angle $\alpha$ about the cylindrical projection F; an arc-shaped aperture at a tail of the slidable knife rack is internally provided with a projecting point G at a tail of the rotary knife rack; two ends of a torsion spring are connected with the projecting point G of the rotary knife rack and a projecting point H of the slidable knife rack respectively; the slidable buckle and the slidable knife rack are slidably connected, and can be engaged with or separated from an adjacent edge of the rotary knife rack.

The safety cutting knife according to the above disclosure uses leverage mechanism to drive the blade out of a hand-held safety knife. Based on leverage mechanism, given that the trigger is driven by a same distance, more force is required to drive the trigger in order to drive the blade out of the knife body by a longer distance.

Another kind of trigger knife that makes use of inclined displacement is also now available in the market. Given that the trigger is driven by a same distance, greater horizontal displacement is required if the blade has to be extended by a longer distance, as such, an angle of inclination of the inclined surface has to be smaller, thereby requiring more force to drive the trigger at the time of use.

In consideration of user's experience, it is desired to provide a trigger that can be driven by the user without using much force. Furthermore, the two kinds of trigger knives described above only allow the trigger to be driven by a short distance, thereby implying short extension of the blade that limits the scope of use of the trigger knives.

BRIEF SUMMARY OF THE INVENTION

In view of the aforesaid disadvantages now present in the prior art, the present invention provides a trigger knife which enables easier and longer extension of the blade, thereby widening the scope of use of the trigger knife and enriching the user's experience.

The present invention has the following technical solutions:

A trigger knife, comprising a knife body, a knife rack, a blade, a resilient piece, a trigger, a transmission mechanism, and a blocking piece, wherein the knife rack, the blade, and the resilient piece are provided inside an inner cavity of the knife body; the knife rack and the knife body are slidably connected; the blade and the knife rack are connected; the resilient piece provides resilient force that enables the blade to retract into the inner cavity of the knife body; the trigger is rotatably provided on the knife body, so that movement of the trigger is partially confined within the inner cavity of the knife body; the trigger is partially exposed from the knife body; the transmission mechanism is provided inside the inner cavity of the knife body; the transmission mechanism comprises a first gear rack, a first gear, a second gear, and a second gear rack; the first gear and the second gear are pivotably connected to the knife body via a rotational axis; a central axis of the rotational axis is perpendicular to a direction along which the knife rack slides; the first gear rack is provided on the trigger and engages with the first gear; the second gear rack is provided on the knife rack and engages with the second gear; a direction along which the second gear rack extends is the same as the direction along which the knife rack slides; the knife rack is provided with a groove; a direction along which the groove extends is the same as the direction along which the knife rack extends; when the blade is extended to a desired position, the blocking piece abuts against a wall surface of the groove.

Further, the groove is a stepped groove; the stepped groove comprises at least two first position limiting grooves of different lengths cooperating with the blocking piece; the first position limiting grooves extend along the same direction along which the knife rack slides; the blocking piece is slidably provided on the knife body, so that the blocking piece is configured to switch abutment thereof against wall surfaces of different first position limiting grooves.

Further, the trigger knife also comprises a supporting assembly in the inner cavity of the knife body; the supporting assembly comprises a mounting piece; the mounting piece is provided with a stepped sliding trough running through an upper side and a lower side of the mounting piece; the stepped sliding trough is has a narrower portion proximal to the upper side of the mounting piece, and has a wider portion proximal to the lower side of the mounting piece; the blocking piece comprises a sliding portion and a position limiting portion; the sliding portion of the blocking piece completely covers up the position limiting portion when viewed from a top side of the sliding portion opposite to a bottom side of the sliding portion where the position limiting portion is positioned; two opposing lateral sides of the position limiting portion are provided with projected portions respectively; the bottom side of the sliding portion not positioned with the position limiting portion abuts against a top side of the mounting piece, and the position limiting portion passes through the stepped sliding trough to cooperate with the first position limiting grooves; top sides of the projected portions abut against a stepped surface of the stepped sliding trough.

Further, the projected portions are movably provided within the stepped sliding trough; side surfaces of the projected portions are spaced apart from side walls of the stepped sliding trough; the supporting assembly also comprises a first position limiting piece removably connected with the mounting piece; the first position limiting piece is provided with a second position limiting groove running through an upper side and a lower side of the first position limiting piece; the second position limiting groove is in communication with the stepped sliding trough; a wall surface of the second position limiting groove provided on the first position limiting piece is provided with at least two concave recesses arranged spaced apart from each other along a direction which the second position limiting groove 831 runs along; a number of the concave recesses corresponds to a number of the first position limiting grooves; a lateral side of the position limiting portion is provided with a projection corresponding to the concave recesses.

Further, each of the concave recesses has a contour of an arc; the projection also has a contour of an arc that matches the arc shape contour of each of the concave recesses.

Further, the knife rack comprises a first connecting rack and a second connecting rack removably connected to each other; the first connecting rack is connected to the second gear rack; the blade is provided on the second connecting rack.

Further, the second connecting rack is provided with a third position limiting groove; the blade is inserted into the third position limiting groove.

Further, the second connecting rack is also provided with a second position limiting piece extending along a direction perpendicular to a direction along which the blade slides; the blade is provided with a notch which allows the second position limiting piece to be fitted therein.

Further, the trigger is provided with a third position limiting piece disposed inside the inner cavity of the knife body, and configured to abut against an inner side wall of the knife body.

Further, one end of the resilient piece is connected to the knife rack, another end of the resilient piece is connected with the knife body.

Compared with the prior art, the present invention has the following beneficial effects:

Since the transmission mechanism comprises gear racks and gears, rotational movement of the trigger can be converted to linear movement of the blade, therefore more force is saved given that the trigger is driven by the same distance as in the prior art, and thereby resulting in easier use of the trigger knife. In addition, since the number of teeth of the second gear is more than the number of teeth of the first gear, an amplified motion transmission effect is achieved such that the blade can be extended forwardly by a longer distance given that the trigger is driven by the same distance as in the prior art. Since the blocking piece is slidably configured on the knife body, and the knife rack is provided with a stepped groove, the length of the blade being extended can be adjusted.

REFERENCES IN THE FIGURES

1—knife body; 11—first shell; 12—second shell; 13—connecting shell; 131—first buckles; 14—third shell; 15—first slot; 16—second slot; 2—knife rack; 21—first connecting rack; 211—second gear rack; 212—second buckle; 213—third buckle; 22—second connecting rack; 221—first position limiting grooves; 222—first docking station; 223—third position limiting groove; 224—second position limiting piece; 3—blade; 4—spring; 5—trigger; 51—first gear rack; 6—first gear; 7—second gear; 8—supporting assembly; 81—blocking piece; 811—sliding portion; 812—position limiting portion; 813—projecting portions; 814—projection; 82—mounting piece; 821—stepped sliding trough; 8211—stepped surface; 822—second docking stations; 823—fourth position limiting groove; 83—first position limiting piece; 831—second position limiting groove; 832—concave recesses; 833—fourth buckles; 834—fifth buckles.

DETAILED DESCRIPTION OF THE INVENTION

The present invention is further described in detail below with reference to some embodiments and the accompanying figures. It should be noted that, new embodiments can be obtained by combining any of the described embodiments or features, given that there is no contradiction.

Figure 1:
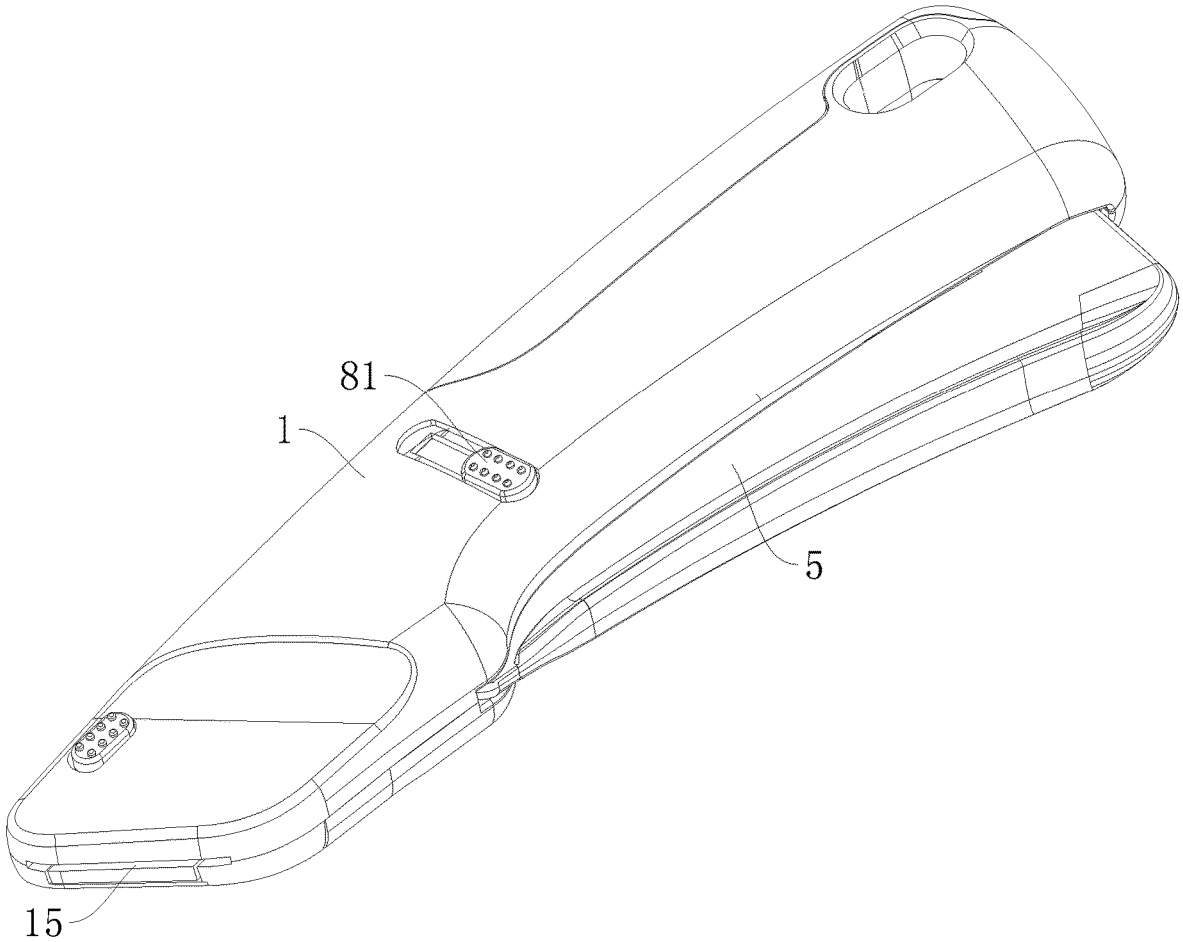
FIG. 1 is a schematic structural view of a trigger knife according to the present invention.
Figure 2:
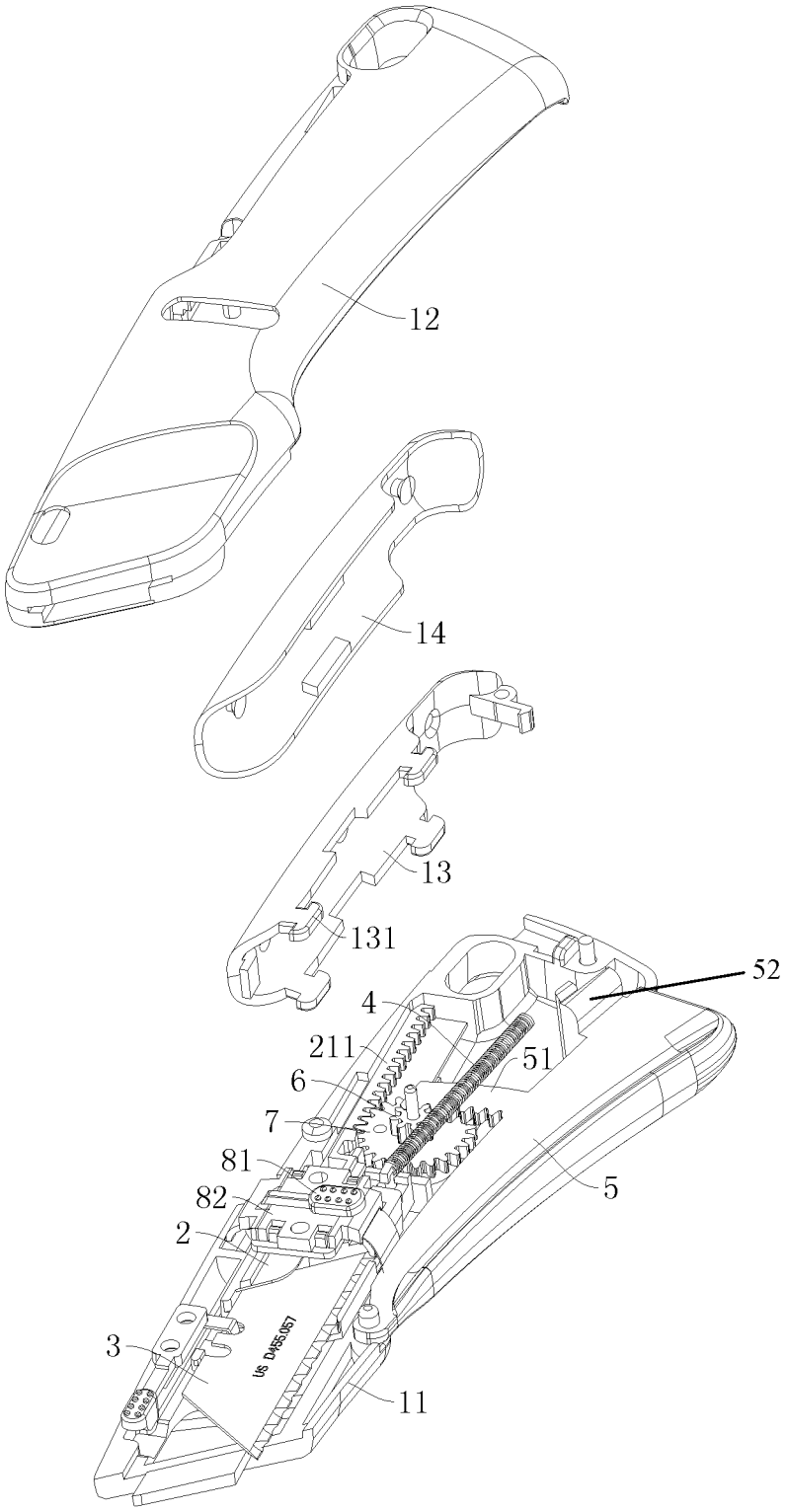
FIG. 2 is an exploded view of the trigger knife shown in FIG. 1.

FIGS. 1-2 illustrate a trigger knife according to a more preferred embodiment. The trigger knife comprises a knife body 1, a knife rack 2, a blade 3, a resilient piece, a trigger 5, a transmission mechanism, and a blocking piece 81, wherein the knife rack 2, the blade 3, the resilient piece and the transmission mechanism are provided inside an inner cavity of the knife body 1; the knife rack 2 and the knife body 1 are slidably connected, so that the blade 3 can extend out of the knife body 1 or retract into the knife body 1 via a first slot 15 provided on the knife body 1; the blade 3 and the knife rack 2 are connected; the resilient piece provides resilient force that enables the blade 3 to retract into the inner cavity of the knife body 1; the trigger 5 is rotatably provided on the knife body 1 via a pivot axis, so that the trigger 5 can move respect to the knife body 1; the trigger 5 is partially exposed from the knife body 1 to allow the trigger 5 to be driven to rotate; the transmission mechanism comprises a first gear rack 51, a first gear 6, a second gear 7, and a second gear rack 211; the first gear 6 and the second gear 7 are pivotably connected to the knife body 1 via a rotational axis, in other words, the rotational axis is pivotably connected with the knife body 1, and the first gear 6 and the second gear 7 are connected to the rotational axis via keys to transmit motion; a number of teeth on the second gear 7 is greater than a number of teeth on the first gear 6; a central axis of the rotational axis is perpendicular to a direction along which the knife rack 2 slides; the first gear rack 51 is provided on the trigger 5 and engages with the first gear 6; the second gear rack 211 is provided on the knife rack 2 and engages with the second gear 7; a direction along which the second gear rack 211 extends is the same as the direction along which the knife rack 2 slides; the blocking piece 81 is provided on the knife body 1 and is partially extended into the inner cavity of the knife body 1; the knife rack 2 is provided with a groove; a direction along which the groove extends is the same as the direction along which the knife rack 2 extends; when the blade 3 is extended to a desired position, the blocking piece 81 abuts against a wall surface of the groove to stop the knife rack 2 from continual linear forward movement so as to limit a position of the knife rack 2 to prevent the knife rack 2 from falling out of the knife body 1.

In the trigger knife of the present invention, by driving the trigger 5 to rotate, the first gear rack 51 drives the first gear 6 to rotate, and the first gear 6 drives the second gear 7 to rotate, and the second gear 7 drives the second gear rack 211 to slide along a direction along which the blade extends, so as to drive the blade 3 out of the knife body 1; when the blade 3 is extended up to a desired position, the blocking piece 81 buts against the wall surface of the groove to stop the knife rack 2 from continual linear forward movement so as to limit the position of the knife rack 2 and to prevent the knife rack 2 from falling out of the knife body 1; when it is required to retract the blade 3 into the knife body 1, release the trigger 5 so that the blade 3 retracts into the knife body 1 via action force of the resilient piece. Since the transmission mechanism comprises gear racks and gears, rotational movement of the trigger 5 can be converted to linear movement of the blade 3, therefore more force is saved given that the trigger 5 is driven by the same distance as in the prior art, and thereby resulting in easier use of the trigger knife. In addition, since the number of teeth of the second gear 7 is more than the number of teeth of the first gear 6, an amplified motion transmission effect is achieved such that the blade can be extended forwardly by a longer distance given that the trigger 5 is driven by the same distance as in the prior art.

Figure 3:
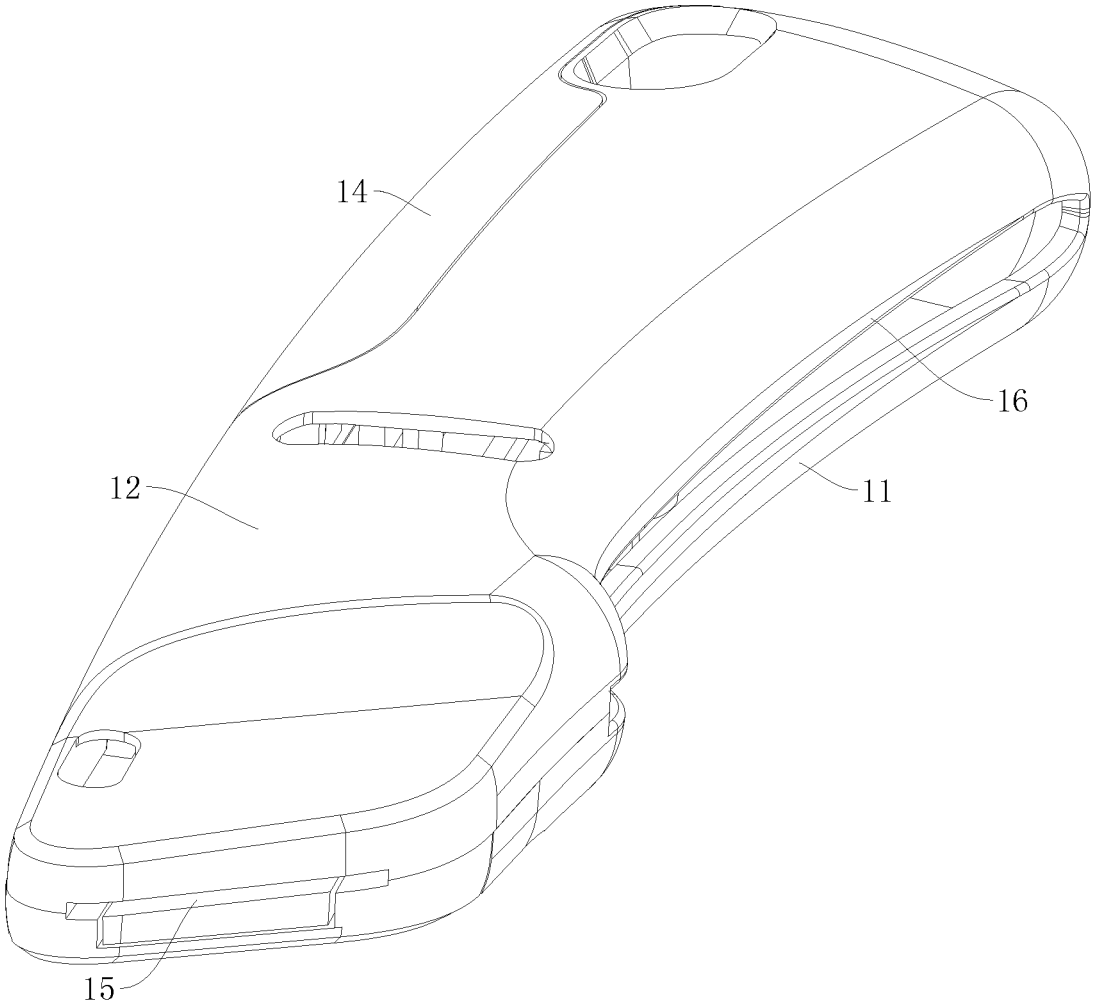
FIG. 3 is a schematic structural view of a knife body of the trigger knife shown in FIG. 2.
Figure 4:
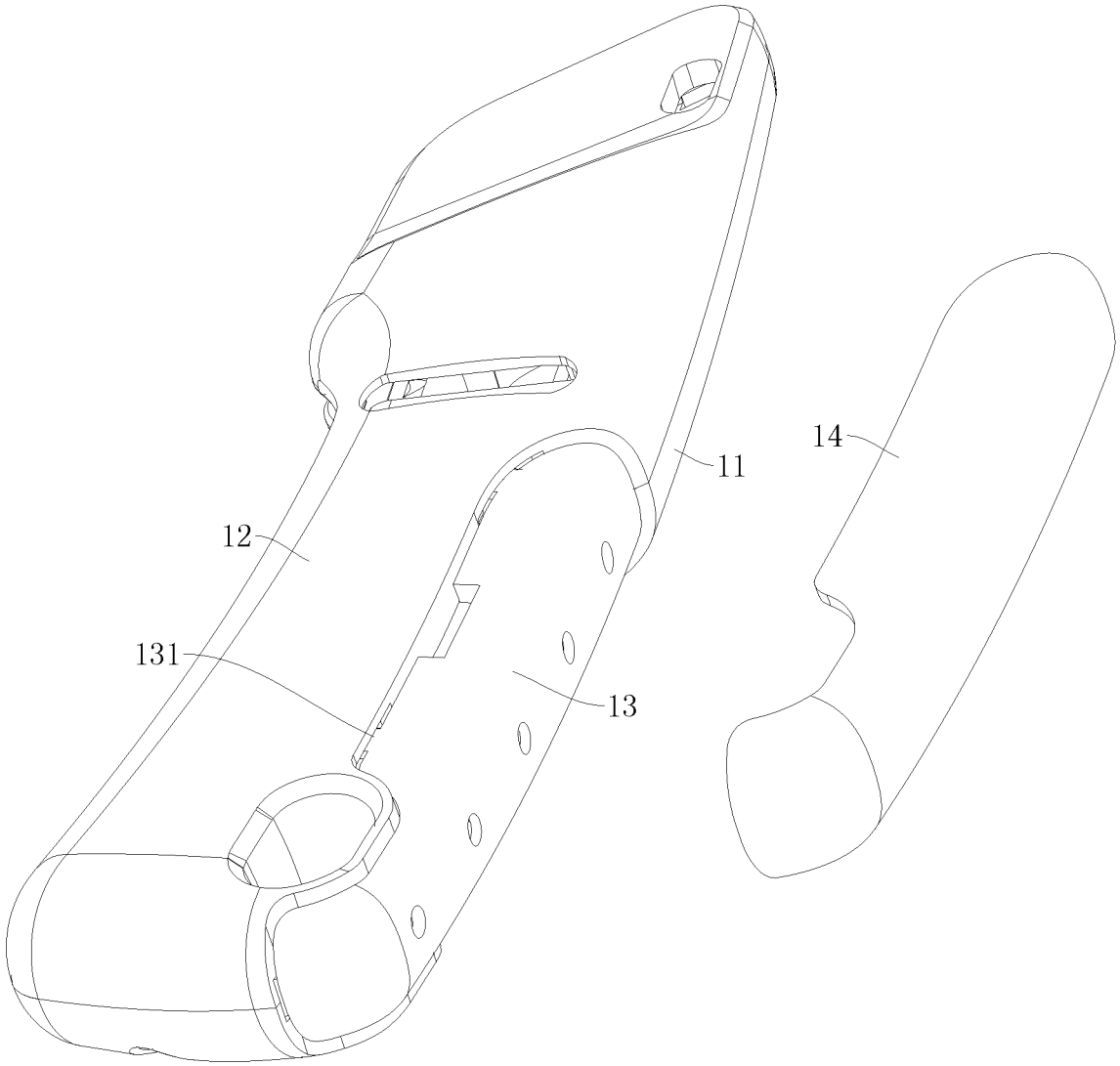
FIG. 4 is a schematic structural view of the knife body shown in FIG. 3, in an alternative angle, wherein the third shell is exploded away.

With reference to FIGS. 2, 3 and 4, the knife body 1 comprises a first shell 11 and a second shell 12; the first shell 11 and the second shell 12 are mutually connected to each other; the first shell 11 and the second shell 12 together enclose an accommodating cavity (which is the inner cavity of the knife body 1) in which components such as the knife rack 2 and the resilient piece are mounted; the first shell and the second shell 12 are connected to each other by screws and bolts, by snap fitting, or by welding. In the present embodiment, the first shell 11 and the second shell 12 are connected to each other by snap fitting to ensure that the knife body 1 can be disassembled.

In order that the first shell 11 and the second shell 12 are connected more reliably, the knife body 1 also comprises a connecting shell 13. As shown in FIG. 2, the connecting shell 13 comprises a cavity that covers a section of a connecting portion between the first shell 11 and the second shell 12; also, first buckles 131 are provided on two sides of the connecting shell 13; when the connecting shell 13 is connected to the first shell 11 and the second shell 12, the first buckles 131 at the two sides of the connecting shell 13 are fastened to buckling grooves of the first shell 11 and buckling grooves of the second shell 12, as shown in FIG. 4.

To ensure a pleasant outer appearance of the knife body 1, the knife body 1 also comprises a third shell 14; as shown in FIGS. 3-4, the third shell 14 and the connecting shell 13 are integrated as a whole using rivets; when the connecting shell 13 and the first shell 11 and the second shell 12 are connected, the third shell 14 covers a recess portion defined by the first shell 11 and the second shell 12, so that an outer surface of the knife body is an integral, smooth surface.

To facilitate mounting of the trigger 5, another section of the connecting portion of the first shell 11 and the second shell 12 is provided with a second slot 16 so that the trigger 5 can be partially exposed from the knife body 1 through the second slot 16 to facilitate the user to drive the trigger 5.

Figure 5:
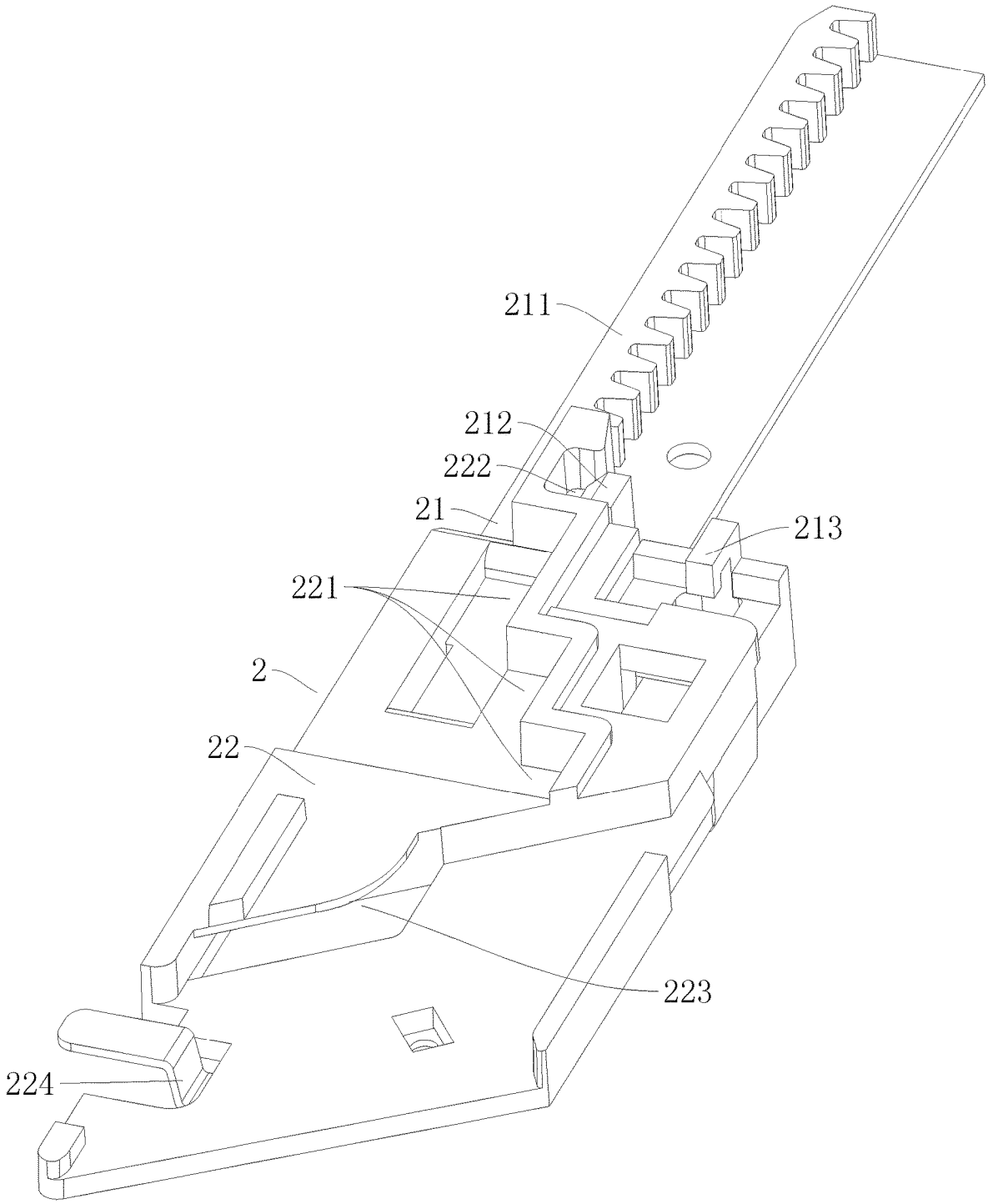
FIG. 5 is a schematic structural view of a knife rack of the trigger knife shown in FIG. 2.

As shown in FIG. 5, the knife rack 2 comprises a first connecting rack 21 and a second connecting rack 22 removably connected to each other; the first connecting rack 21 is connected to the second gear rack 211; the blade 3 is provided on the second connecting rack 22. In the present embodiment, the first connecting rack 21 and the second gear rack 211 are configured as an integral structure.

Specifically, to achieve the removable connection between the first connecting rack 21 and the second connecting rack 22, the first connecting rack 21 is provided with a second buckle 212, and the second connecting rack 22 is provided with a first docking station 222 that connects with the second buckle 212, so as to facilitate quick assembly and disassembly of the first connecting rack 21 and the second connecting rack 22. Of course, the first connecting rack 21 and the second connecting rack 22 can be connected by bolts or rivets.

Specifically, to achieve removable connection between the blade 3 and the second connecting rack 22, the second connecting rack 22 is provided with a third position limiting groove 223; the blade is inserted into the third position limiting groove 223 to ensure on one hand secured connection between the blade 3 and the second connecting rack 22, and on the other hand convenient replacement of the blade 3.

Further, to ensure reliable connection between the blade 3 and the second connecting rack 22, the second connecting rack 22 is also provided with a second position limiting piece 224 extending along a direction perpendicular to a direction along which the blade 3 slides; the blade 3 is provided with a notch which allows the second position limiting piece 224 to be fitted therein.

Further, the trigger 5 is provided with a third position limiting piece disposed inside the inner cavity of the knife body 1, and configured to abut against an inner side wall of the knife body 1 to achieve position limiting of the trigger 5, so that movement of the trigger 5 is always partially confined within the inner cavity of the knife body 1.

Further, one end of the resilient piece is connected to a third buckle 213 of the knife rack 2, another end of the resilient piece is connected with a fixing buckle (not shown in the figures) of the knife body 1; the resilient piece can be a spring 4, a resilient rubber or resilient sleeving cylinder. In the present embodiment, the resilient piece is preferably a spring 4.

As shown in FIG. 5, the groove of the knife rack is provided on the second connecting rack 22. Preferably, the groove is a stepped groove; the stepped groove comprises at least two first position limiting grooves 221 of different lengths cooperating with the blocking piece 81; the first position limiting grooves 221 extend along the same direction along which the knife rack 2 slides; the blocking piece 81 is slidably provided on the knife body 1; a direction along which the blocking piece 81 slides is tilted with respect to or perpendicular to the direction along which the blade 3 slides, so that the blocking piece 81 can switch its abutment against wall surfaces of different first position limiting grooves 221. Since the groove is a stepped groove, the blocking piece 81 can be adjusted to different positions according to practical need of the user. When the knife rack 2 moves forward linearly, a side surface of the blocking piece 81 comes into contact with the first position limiting grooves 221 of different lengths provided on the knife rack 2, so as to stop the forward linear movement of the knife rack 2, thereby achieving the effect of adjusting different extended lengths of the blade.

Figure 6:
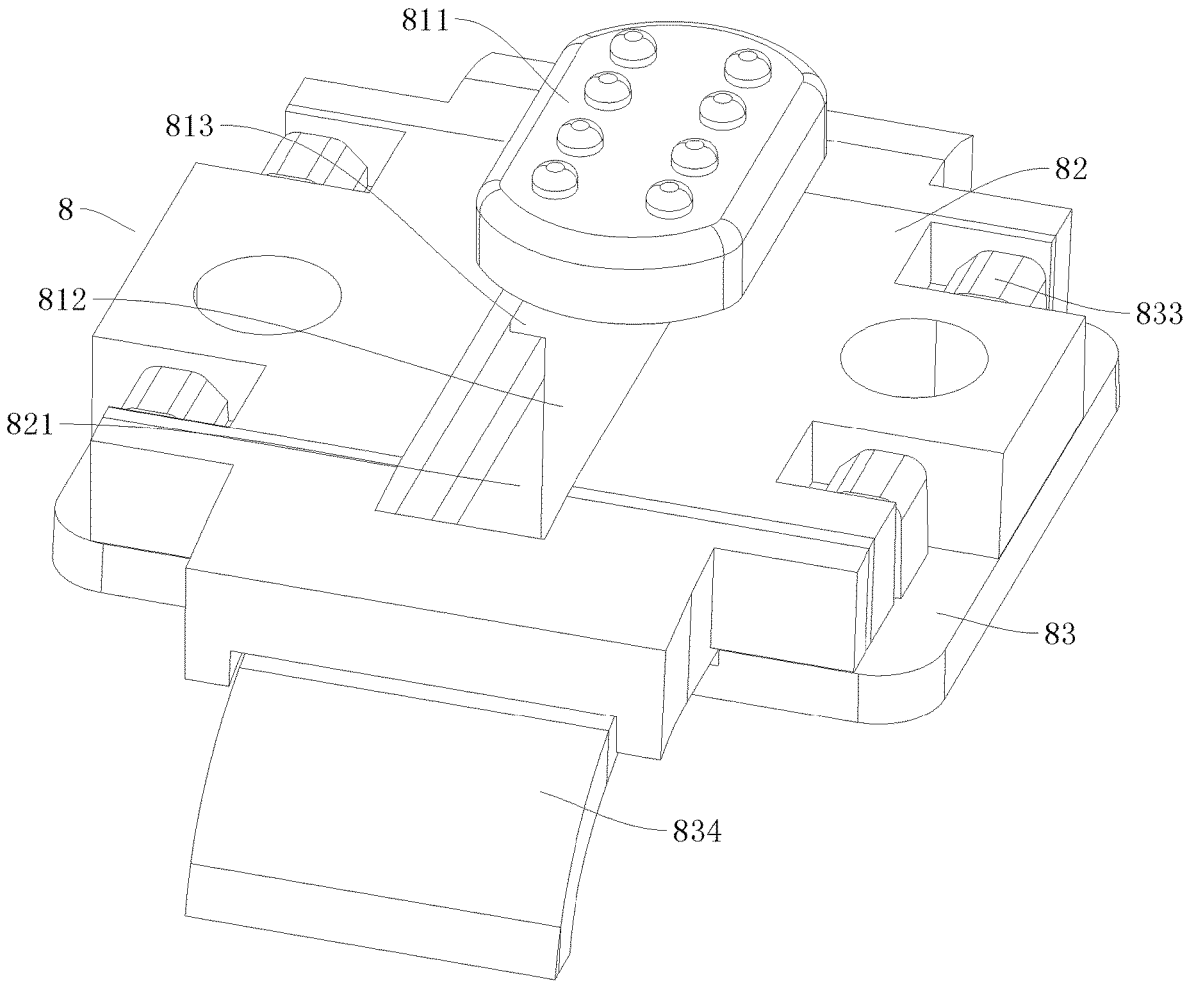
FIG. 6 is a schematic structural view of a supporting assembly of the trigger knife shown in FIG. 6.
Figure 7:
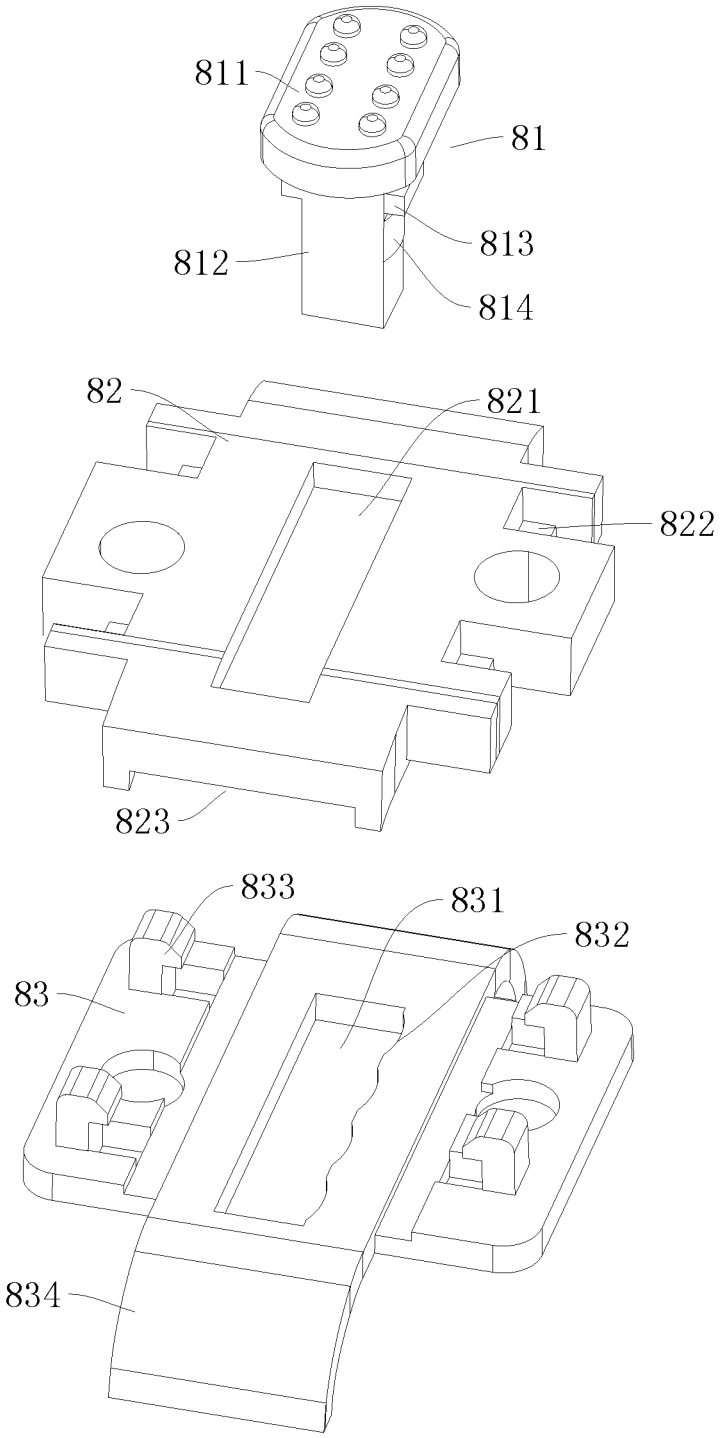
FIG. 7 is an exploded view of the supporting assembly shown in FIG. 6.
Figure 8:
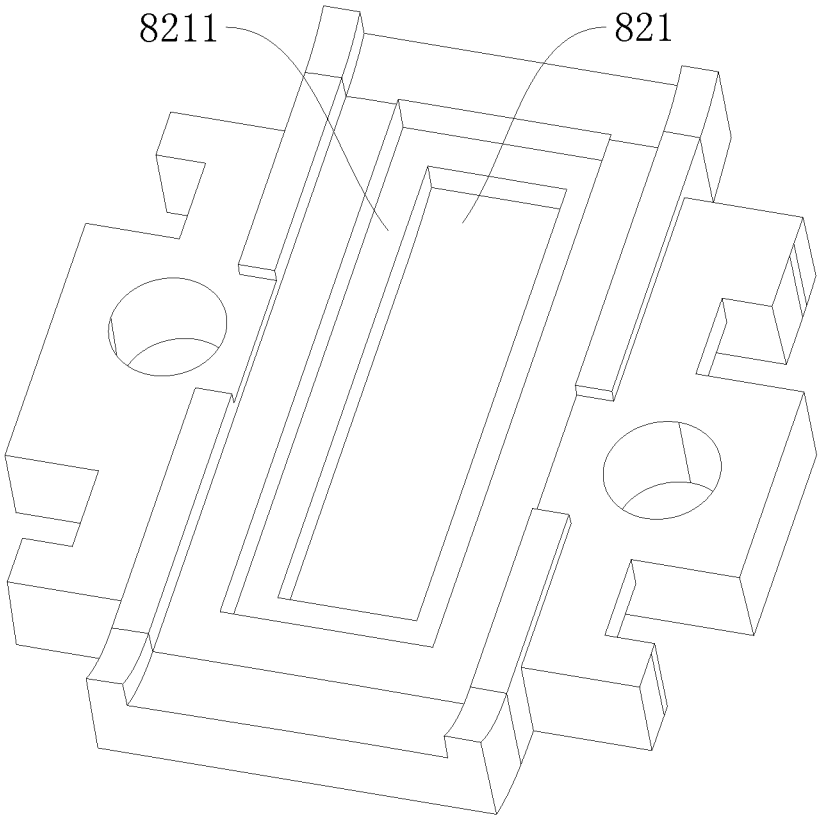
FIG. 8 is a schematic structural view of a reverse side of a mounting piece of the supporting assembly shown in FIG. 7.

Further, in order to achieve slidable connection between the blocking piece 81 and the trigger knife, the trigger knife also comprises a supporting assembly 8 in the inner cavity of the knife body 1. As shown in FIG. 6 in particular, the supporting assembly 8 comprises a mounting piece 82; the mounting piece 82 is provided with a stepped sliding trough 821 running through an upper side and a lower side of the mounting piece 82; as shown in FIG. 7 and FIG. 8, the stepped sliding trough 821 is narrower proximal to the upper side of the mounting piece 82, and is wider proximal to the lower side of the mounting piece 82; the blocking piece 81 comprises a sliding portion 811 and a position limiting portion 812; the sliding portion 811 of the blocking piece 81 completely covers up the position limiting portion 812 when viewed from a top side of the sliding portion 811 opposite to a bottom side of the sliding portion 811 where the position limiting portion 812 is positioned; two opposing lateral sides of the position limiting portion 812 are provided with projected portions 813 respectively; the bottom side of the sliding portion not positioned with the position limiting portion 812 abuts against a top side of the mounting piece 82, and the position limiting portion 812 passes through the stepped sliding trough 821 to cooperate with the first position limiting grooves 221; top sides of the projected portions 813 abut against a stepped surface 8211 of the stepped sliding trough 821. As such, the sliding piece 81 can be slidably mounted to the mounting piece 82, and will not fall off from the mounting piece 82. It can be understood that, to mount the blocking piece 81 to the mounting piece 82, position the blocking piece 81 such that the projected portions 813 extend along a direction parallel to a direction which the stepped sliding trough 821 runs along, and then position the position limiting portion 812 to pass through the stepped sliding trough 821, and finally rotate and adjust the projected portions 813 such that the projected portions 813 abut against the stepped surface 8211 of the stepped sliding trough 821, thereby completing the slidable connection between the blocking piece 81 and the mounting piece 82.

To achieve reliable positioning of the blocking piece 81, the projected portions 813 is movably provided within the stepped sliding trough 821; side surfaces of the projected portions 813 are spaced apart from side walls of the stepped sliding trough 821, in other words, when the projected portions 813 abut against the stepped surface 8211 of the stepped sliding trough 821, sides of the projected portions 813 opposite to sides of the projected portions 813 connected to the position limiting portion 812 are spaced apart from side walls of a wider portion of the stepped sliding trough 821; also, there are gaps existing between the position limiting portion 812 and a narrower portion of the stepped sliding trough 821; accordingly, the projected portions 813 can move within the stepped sliding trough 821; the supporting assembly 8 also comprises a first position limiting piece 83 removably connected with the mounting piece 82; the first position limiting piece 83 is provided with a second position limiting groove 831 running through an upper side and a lower side of the first position limiting piece 83; the second position limiting groove 831 is in communication with the stepped sliding trough 821; a wall surface of the second position limiting groove 831 provided on the first position limiting piece 83 is provided with at least two concave recesses 832 arranged spaced apart from each other along a direction which the second position limiting groove 831 runs along; when the first position limiting piece 83 is mounted inside the trigger knife, the concave recesses 832 are more proximal to a side of the blade 3; a number of the concave recesses 832 corresponds to a number of the first position limiting grooves 221; a lateral side of the position limiting portion 812 is provided with a projection 814 corresponding to the concave recesses 832; when sliding the blocking piece 81 to a position where the position limiting portion 812 abuts against any one of the first position limiting grooves 221, the blocking piece 81 can also be pushed along a direction parallel to a direction along which the blade 3 extends or retracts until the projection 814 on the position limiting portion 812 is fitted with a corresponding concave recess 832; accordingly, by means of the concave recesses 832 and the wall surfaces of the first position limiting grooves 221, position limiting of the blocking piece 81 can be achieved, thereby ensuring that the blade 3 is stably maintained at a certain extended length for easier use of the trigger knife.

Preferably, each of the concave recesses 832 has a contour of an arc; the projection 814 also has a contour of an arc that matches the arc shape contour of each of the concave recesses 832, so as to facilitate production and positional adjustment of the blocking piece 81.

As shown in FIG. 7, in order to achieve removable connection between the first position limiting piece 83 and the mounting piece 82, two opposing sides of the first position limiting piece 83 are provided with fourth buckles 833 respectively. Correspondingly, opposing sides of the mounting piece 82 are provided with second docking stations 822 that connect correspondingly to the fourth buckles 833; also, to achieve reliable connection between the first position limiting piece 83 and the mounting piece 82, a fourth position limiting groove 823 corresponding to a central part of the first position limiting piece 83 is provided at a bottom side of the mounting piece 82; the fourth position limiting groove 823 has a shape corresponding to a shape of the central part of the first position limiting piece 83 (as shown specifically in FIG. 8); by means of this configuration, the first position limiting piece 83 and the mounting piece 82 can be quickly assembled and disassembled. Of course, the first position limiting piece 83 and the mounting piece 82 can be connected to each other via bolts.

To facilitate connection between the supporting assembly 8 and the knife body 1, another two opposing sides of the first position limiting piece 83 are provided with fifth buckles 834 each being configured in an arc shape. Corresponding, two opposing sides of the first shell 11 are provided with buckle holes configured to be fitted with the fifth buckles 834.

The present invention has the following advantages:

1. Since the transmission mechanism of the present invention uses gears and gear racks, force is saved given that the trigger is driven by the same distance as in the prior art.

2. Since the number of teeth of the second gear 7 is more than the number of teeth of the first gear 6, the blade can be extended by a longer length given that the trigger 5 is driven by the same distance as in the prior art.

3. Since the blocking piece 81 is slidably configured on the knife body 1, and the knife rack 2 is provided with a stepped groove, the length of the blade being extended can be adjusted.

The embodiments described above are only the preferred embodiments of the present invention, and should not limit the scope of protection of the present invention. Any non-substantive changes or replacements made by a person skilled in this field of art based on the teachings of the present invention should also fall within the scope of protection of the present invention.

What is claimed is:

1. A trigger knife, comprising a knife body, a knife rack, a blade, a resilient piece, and a trigger, wherein the knife rack, the blade, and the resilient piece are provided inside an inner cavity of the knife body; the knife rack and the knife body are slidably connected; the blade and the knife rack are connected; the resilient piece provides resilient force that enables the blade to retract into the inner cavity of the knife body; the trigger is rotatably provided on the knife body, so that movement of the trigger is partially confined within the inner cavity of the knife body; the trigger is partially exposed from the knife body; wherein the trigger knife also comprises a transmission mechanism and a blocking piece; the transmission mechanism is provided inside the inner cavity of the knife body; the transmission mechanism comprises a first gear rack, a first gear, a second gear, and a second gear rack; the first gear and the second gear are pivotably connected to the knife body via a rotational axis; a number of teeth of the second gear is greater than a number of teeth of the first gear; the first gear rack is provided on the trigger and engages with the first gear; the second gear rack is provided on the knife rack and engages with the second gear; a direction along which the second gear rack extends is the same as a direction along which the knife rack slides; the blocking piece is provided on the knife body, and is partially extended into the inner cavity of the knife body; the knife rack is provided with a groove; a direction along which the groove extends is the same as a direction along which the knife rack extends; when the blade is extended to a desired position, the blocking piece abuts against a wall surface of the groove.

2. The trigger knife according to claim 1, wherein the groove is a stepped groove; the stepped groove comprises at least two first position limiting grooves of different lengths cooperating with the blocking piece; the first position limiting grooves extend along the same direction along which the knife rack slides; the blocking piece is slidably provided on the knife body; a direction along which the blocking piece slides is tilted with respect to or perpendicular to a direction along which the blade slides, so that the blocking piece is configured to switch abutment thereof against wall surfaces of different first position limiting grooves.

3. The trigger knife according to claim 2, wherein the trigger knife also comprises a supporting assembly in the inner cavity of the knife body; the supporting assembly comprises a mounting piece; the mounting piece is provided with a stepped sliding trough running through an upper side and a lower side of the mounting piece; the stepped sliding trough has a narrower portion proximal to the upper side of the mounting piece, and has a wider portion proximal to the lower side of the mounting piece; the blocking piece comprises a sliding portion and a position limiting portion; the sliding portion of the blocking piece completely covers up the position limiting portion when viewed from a top side of the sliding portion opposite to a bottom side of the sliding portion where the position limiting portion is positioned; two opposing lateral sides of the position limiting portion are provided with projected portions respectively; the bottom side of the sliding portion not positioned with the position limiting portion abuts against a top side of the mounting piece, and the position limiting portion passes through the stepped sliding trough to cooperate with the first position limiting grooves; top sides of the projected portions abut against a stepped surface of the stepped sliding trough.

4. The trigger knife according to claim 3, wherein the projected portions are movably provided within the stepped sliding trough; side surfaces of the projected portions are spaced apart from side walls of the stepped sliding trough; the supporting assembly also comprises a first position limiting piece removably connected with the mounting piece; the first position limiting piece is provided with a second position limiting groove running through an upper side and a lower side of the first position limiting piece; the second position limiting groove is in communication with the stepped sliding trough; a wall surface of the second position limiting groove provided on the first position limiting piece is provided with at least two concave recesses arranged spaced apart from each other along a direction which the second position limiting groove runs along; a number of the concave recesses corresponds to a number of the first position limiting grooves; a lateral side of the position limiting portion is provided with a projection corresponding to the concave recesses.

5. The trigger knife according to claim 4, wherein each of the concave recesses has a contour of an arc; the projection also has a contour of an arc that matches the arc shape contour of each of the concave recesses.

6. The trigger knife according to claim 1, wherein the knife rack comprises a first connecting rack and a second connecting rack removably connected to each other; the first connecting rack is connected to the second gear rack; the blade is provided on the second connecting rack.

7. The trigger knife according to claim 6, wherein the second connecting rack is provided with a third position limiting groove; the blade is inserted into the third position limiting groove.

8. The trigger knife according to claim 7, wherein the second connecting rack is also provided with a second position limiting piece extending along a direction perpendicular to a direction along which the blade slides; the blade is provided with a notch which allows the second position limiting piece to be fitted therein.

9. The trigger knife according to claim 1, wherein the trigger is provided with a third position limiting piece disposed inside the inner cavity of the knife body, and configured to abut against an inner side wall of the knife body.

10. The trigger knife according to claim 1, wherein one end of the resilient piece is connected to the knife rack, another end of the resilient piece is connected with the knife body.

* * * * *